United States Patent [19]

Roberts et al.

[11] Patent Number: 4,638,820

[45] Date of Patent: Jan. 27, 1987

[54] PUFF CONTROL CIGARETTE

[75] Inventors: Donald L. Roberts; Anthony L. Angel; Douglas C. Clark, all of Winston-Salem, N.C.; Jack F. Clearman, Blakely, Ga.; T. Stephen Sink, Lexington, N.C.

[73] Assignee: R. J. Reynolds Tobacco Company, Winston-Salem, N.C.

[21] Appl. No.: 825,563

[22] Filed: Feb. 3, 1986

[51] Int. Cl.[4] ..... A24D 3/04

[52] U.S. Cl. ..... 131/336; 131/198.2; 131/338; 131/339

[58] Field of Search ..... 131/336, 198.1, 198.2, 131/338, 339

[56] References Cited

U.S. PATENT DOCUMENTS 3,695,274 10/1972 Summers ..... 131/198.2

*Primary Examiner*—Vincent Millin

*Attorney, Agent, or Firm*—Manford R. Haxton

[57] ABSTRACT

A smoking article which delivers to a smoker during each puff a flowstream having a higher concentration of smoke during the first portion of the puff and a lower concentration of smoke during the remainder of the puff.

6 Claims, 9 Drawing Figures

PUFF CONTROL CIGARETTE

TECHNICAL FIELD

This invention relates to cigarettes and other smoking articles generally and more particularly to cigarettes provided with smoke control devices to regulate the quantity and composition of the smokestream delivered to the smoker.

DESCRIPTION OF THE PRIOR ART

The trend in cigarette manufacturing in recent years has been to lower the delivery of smoke to the smoker. This has most commonly been accomplished by producing filter cigarettes having perforations in the tipping paper to admit ventilation air into the filter to dilute the smoke. Filtering of the smoke and admitting air into the smokestream adversely affects the flavor of the cigarette. As the amount of the dilution air is increased and the concentration of the smoke is reduced, the flavor of the cigarette is reduced. Thus, there has been a tradeoff of reduced flavor in return for the delivery of less particulate matter and nicotine to the smoker. In some cigarettes this tradeoff is effected by the smoker who can adjust the amount of ventilation air admitted into the cigarette and thus vary the concentration of smoke in the smokestream. Examples of this technique include Regal et al, U.S. Pat. No. 3,503,406 and Thompson, U.S. Pat. No. 3,359,988, which use sliding external mechanical sleeves which must be positioned so that openings in the slideable sleeve are aligned with openings in the filter mouthpiece to admit more air into the cigarette. An example of a cigarette holder with adjustable air dilution is Kleinhans, U.S. Pat. No. 3,685,522.

Examples of cigarette filter devices which use valves designed to open during a puff by the smoker include U.S. Pat. Nos. 3,533,414 and 3,616,802. Filter valves of this type, however, permit an increased flow of smoke as the pressure drop or suction is increased by the smoker during a puff.

A smoke control filter device which operates differently is disclosed in U.S. Pat. No. 4,119,105. This device contains a valve in the smokestream which closes when a predetermined smokestream flow rate is reached. The closing of the valve abruptly ends the smoke flow and thus the puff in order to limit the amount of smoke which a smoker can get during a puff.

Another device which operates to change smoke concentration during a puff by the use of a valve means is disclosed in Offenlegungsschrift No. 2130862, published Dec. 28, 1972. This German patent application discloses a cigarette holder having a valve which opens at the beginning of a puff to admit ambient ventilation air and then closes as the puff flow rate increases to stop the airflow, increasing the amount of tobacco smoke inhaled by the smoker.

None of the foregoing devices deliver to the smoker full-flavor smoke while at the same time limiting the delivery of particulate matter and nicotine during what is perceived by the smoker to be a normal puff. Accordingly, it is an object of this invention to provide a smoking device which delivers full-flavor smoke during each puff by a smoker while curtailing the amount of particulate matter and nicotine delivered.

SUMMARY OF THE INVENTION

According to this invention, there is provided a smoking article which delivers to a smoker during each puff a stream having a higher concentration of smoke during the first portion of the puff and a lower concentration of smoke air during the remainder of the puff. A preferred embodiment is a cigarette comprising, in combination, a tobacco rod, air ventilation means for providing air to the mouth end of the smoking article, and valve means adapted to deliver to a smoker during each puff a stream which is predominately smoke from the tobacco during the first portion of the puff and predominately air from the air ventilation means during the remainder of the puff. While tobacco is a preferred smoke producing material, other means for producing a flavorful smoke aerosol may be employed.

As pointed out above, undiluted smoke provides more flavor to a smoker than does smoke diluted by air. The trend during recent years has been to lower particulate matter and nicotine delivery of cigarettes. This has been achieved, in large part, by perforating the tipping paper to dilute the smoke with ventilation air. This has achieved the goal of lowering smoke delivery, but at the cost of also lowering flavor and smoker satisfaction. The present invention solves this problem by delivering a puff flow stream having a high concentration of smoke to a smoker during the first portion of each puff, followed by a stream consisting of mostly or all air. This action takes place automatically without the smoker having to alter his or her normal or typical puff flow-rate profile to achieve it.

Studies have shown that a typical smoker takes a puff which lasts about 1.75 seconds during which time the total puff volume is about 44 cc. The flow rate during a puff starts from 0, increases to a maximum and then decreases back to 0 at the end of the puff. For a typical smoker, the maximum flow rate obtained during a puff from a cigarette is about 70 cc's per second.

The smoking article of the present invention changes the puff flow stream from a higher concentration of smoke to a lower concentration of smoke at a puff flow rate in the range of about 2 to about 35 cubic centimeters per second (cc/sec.), preferably 8 to 25 cc/sec., optimally at about 10 to about 15 cc/sec. The flow rate at which the valve means operates to change the composition of the puff flow stream from a higher concentration of smoke to a higher concentration of ventilation air is called the cut-off puff flow rate.

This invention will be described as applied to cigarettes, however, it has application to other forms of smoking articles, such as cigarette holders. It is believed that the widest application of the present invention is in connection with cigarettes, however, it should not be construed to be limited thereto.

BRIEF DESCRIPTION OF THE DRAWINGS

In order that the invention may be more readily understood and carried into effect, reference is made to the accompanying drawings and detailed description thereof, which are offered by way of illustration only and not in limitation of the invention.

In the drawings.

DETAILED DESCRIPTION OF THE PREFERRED EMBODIMENTS

Figure 1:
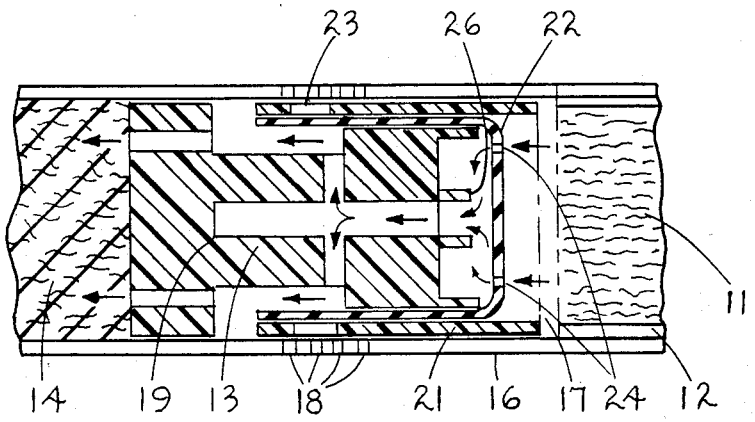
FIG. 1 is a cross-section perpendicular to the longitudinal axis of a first embodiment of a smoking article of the present invention.

Referring now to the embodiment illustrated in FIG. 1, a portion of a cigarette is shown comprising a tobacco rod 11, wrapped in cigarette paper 12 to which is affixed valve and ventilation means 13 and fibrous filter 14 by tipping paper 16. Optional fibrous filter pad 17 may be included between the filter-ventilation means and the tobacco rod, if desired, to assure that no tobacco particles from the tobacco rod enter the valve mechanism and interfere with its operation. Ventilation air conduits 18 are provided in the tipping paper by perforating the tipping paper either before or after the smoking article is assembled. In this embodiment, valve means to control ventilation air and smoke flows comprises three parts: valve body 19, cylinder 21 and latex rubber element 22. Cylinder 21, made of a plastic or other suitable material, is provided with openings 23 which register with at least some of ventilation air conduits (perforations) 18 in tipping paper 16. Latex cup 22 is positioned over the tobacco rod end of valve body 19 and held in place by cylindrical tube 21. The bottom of the latex rubber cup which faces the rod of smoking material is provided with openings 24 for passage of smoke from the smoking material through the latex cup membrane, through a central opening in the valve body thence through passageways through the valve body, into the cigarette filter and then to the smoker's mouth. The size of openings 24 and the flexibility of membrane 22 are selected so that when the desired smoke cut-off puff flow rate is reached, membrane 22 comes in contact with opening 26 in the valve body portion, thus stopping the flow of smoke from the smoking material into the valve body. At this time the skirt portion of latex cup 22 is pulled away from openings 23 by the continuing suction from the smoker, thus admitting ventilation air into the passageways within the valve body from whence the air flows through the filter and into smoker's mouth to provide a gas flow for uninterrupted continuation of the smoker's normal puff. At the end of the puff, the skirt portion closes the ventilation air holes and the latex rubber cup bottom, membrane 22, returns to the open position so that at the beginning of the next puff, smoke will flow from the smoking material until the desired smoke cut-off flow rate is again reached.

Figure 2:
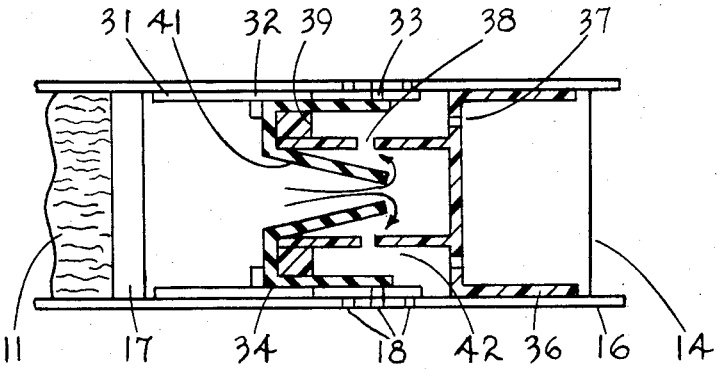
FIG. 2 is a longitudinal cross-section of a second embodiment of the present invention.

In FIG. 2, there is depicted a second embodiment of the valve-ventilation device of the present invention. This embodiment comprises tube member 31 having an internal shoulder ring 32 and openings 33 for admitting air to the interior of the device; latex rubber piece or pieces 34; and positioning piece 36 having passageways 37 and 38 for the passage of smoke therethrough. This part of a smoking device may also be provided with an optional filter 17 to prevent particles of smoking material 11 from interfering with the operation of the valves. This valve-ventilation device can be a part of a smoking device such as a cigarette holder, but will be described as being a part of a cigarette. The assembled device is attached to a tobacco rod and optionally to a cigarette filter by tipping paper 16 provided with perforations 18 in register with openings 33 of the valve-ventilation device. Positioning part 36 is provided with protrusions 39 which serve to secure the latex rubber piece or pieces 34 in place. In operation, latex rubber skirt or flaps cover the openings 33 preventing air from entering through passageways or conduits 18 into the interior of the mouthpiece. Latex skirt or flaps 41 stand away from openings 38 permitting smoke to pass from the smoking material 11 through filter pad 17, openings 38, and 37 into and through filter 14 into the smoker's mouth. As the puff progresses and puff velocity increases, flaps 41 are forced against the inner wall of the tubular portion of positioning piece 36 to cover openings 38 preventing further flow of smoke therethrough. When this happens as the puff is continuing, the pressure in annular space 42 decreases causing air to flow through openings 33 by flexing away the flaps or skirt covering these openings. The cooperative combined action of the two sets of flaps or skirts thus causes the puff stream to change from predominately smoke during the early part of the puff to predominately air during the remainder of the puff. Upon completion of the puff as the puff flow rate approaches zero, the flaps and skirts return to the normal at-rest position in preparation for delivering predominately smoke to the smoker during the first part of the subsequent puff.

Figure 3:
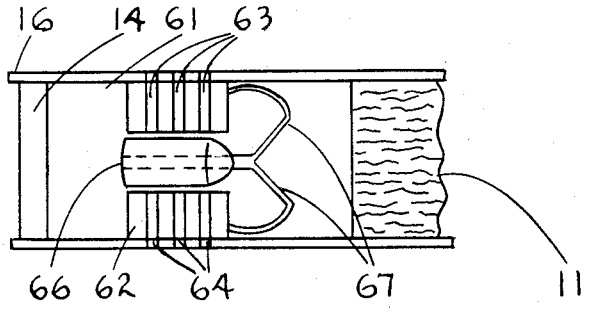
FIG. 3 is a longitudinal cross-section of a third embodiment of the present invention.

Another embodiment of the valve-ventilation means of the smoking article of the present invention is illustrated in FIG. 3. This embodiment comprises a cylindrical duct 61 having positioned therein tube 62, the wall of which is provided with air ventilation conduits 63 in registration with tipping perforations 64 for admitting air into the interior of the device. A cylinder 66 is slideably positioned within tube 62 and held in place by a plurality of flexible straps 67. Cylinder 66 is provided with a central passageway for passage of the puff stream. Cylinder 66 is shown in FIG. 3 in the at-rest position between puffs. As the smoker begins a puff, smoke flows from smoking material 11 through the central passageway of cylinder 66 through filter 14 into the smoker's mouth. As the flow rate of the puff increases to a preselected level, cylinder 66 is drawn by pressure drop back toward the mouth end of the device against the tension of flexible straps 67. As the cylinder 66 is drawn farther back, openings 63 and 64 become unobstructed and ventilation air flows into the interior of the device to change the composition of the puff flow stream from predominately smoke to predominately air. Flexible straps 67 have sufficient strength to return the cylinder to the at-rest position at or near the completion of a puff.

Figure 4:
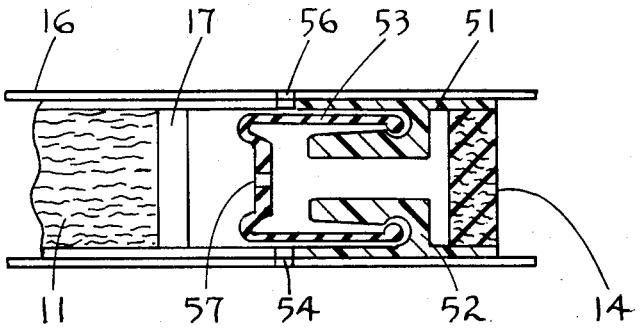
FIG. 4 is a longitudinal cross-section of a fourth embodiment of the present invention.

The embodiment shown in FIG. 4 also uses a flexible material such as latex rubber for construction of the valve means. Inner tube means 51 is provided with support means 52 to hold cuplike latex valve means 53 in place. The wall of the tube is provided with openings 54 for admitting air into the interior of the smoking device through connecting perforations 56 in tipping paper 16. The tipping paper serves to hold together the tobacco rod 11 the valve-ventilation device and optional fibrous filter 14 to form the completed cigarette. The bottom portion of latex rubber cup 53 is provided with an opening 57 for passage of the puff flow stream. As a puff is initiated, smoke flows from smoking material 11 through opening 57 and filter 14 into the smoker's mouth. As the flow rate of the puff increases, the pressure drop across the bottom of latex rubber cup 53 also increases causing the bottom of the cup to flex toward the mouth end of the smoking device. As this happens, air ventilation openings 54 and 56 are uncovered as the latex rubber valve rolls down. The total area of the ventilation openings is such that the pressure drop across the air ventilation openings is less than the pressure drop through the rod of smoking material, therefore, smokeflow is decreased as airflow is increased such that during the latter portion of the puff, the puff flow stream is predominately air. After the puff is completed, the latex cup valve returns to its at-rest position again covering the air ventilation openings.

Figure 5:
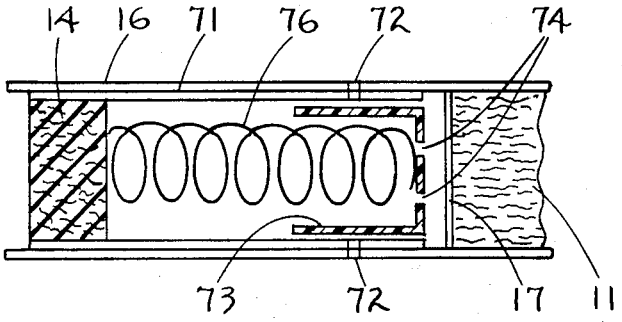
FIG. 5 is a longitudinal cross-section of a fifth embodiment of the present invention.

In FIG. 5 is illustrated still another embodiment of the valve-ventilation means of the present invention. This embodiment comprises tube member 71 positioned between fibrous filter 14 and filter pad 17 next to tobacco rod 11 and held in position by tipping paper 16 to form the smoking device of the present invention. The tube and the tipping paper are provided with openings 72 in registration so that air passes into the interior of the tube when these openings are unobstructed. Rigid plastic cup 73 is slideably positioned within tube 71. The one bottom end of cup 73 is provided with one or more openings 74 through which the puff flow stream passes on its way through filter 14 to the smoker's mouth. Cup 73 is urged toward the tobacco rod end of the device by spring 76. A satisfactory spring 76 was made by wrapping fish-line leader around a rod and gently heating it. As the smoker draws on the smoking device and puff flow rate increases, the pressure drop across openings 74 increases causing the cup 73 to slide down tube 71 uncovering openings 72 which are large and numerous enough to have a lower pressure drop than the pressure drop through the rod of smoking material so that the flow of air through these openings is greater than the flow of smoke from the rod of smoking material. Thus, the composition of the puff stream is changed from predominately smoke during the first portion of the puff to predominately air during the remainder of the puff. Upon completion of the puff, the spring urges the cup back into its at-rest position in preparation for delivery of predominately smoke to the smoker's mouth at the beginning of the subsequent puff.

Figure 6:
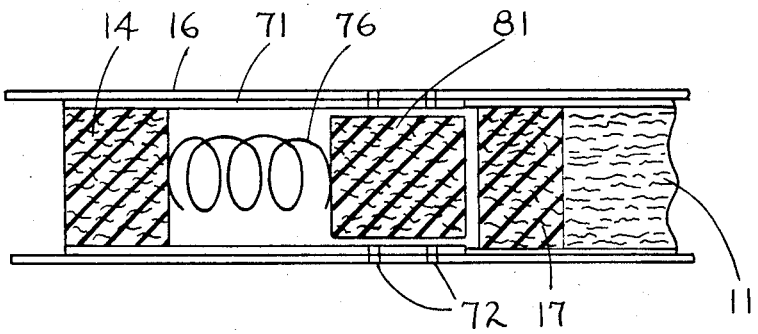
FIG. 6 is a longitudinal cross-section of a sixth embodiment of the present invention.

The embodiment illustrated in FIG. 6 is quite similar to the embodiment shown in FIG. 5. In FIG. 6, the cup 73 of FIG. 5 is replaced by a fibrous filter plug 81 of cellulose acetate, polypropylene or other fibrous material. As the smoker draws on the cigarette, the filter plug moves down the cylinder to open the ventilation holes and increase the air dilution of the smokestream. The size and number of ventilation air conduit perforations are selected so that when the cellulose acetate plug moves back far enough to uncover the openings, the flow of air is sufficient to change the composition of the puff stream from predominately smoke to predominately air.

Figure 7:
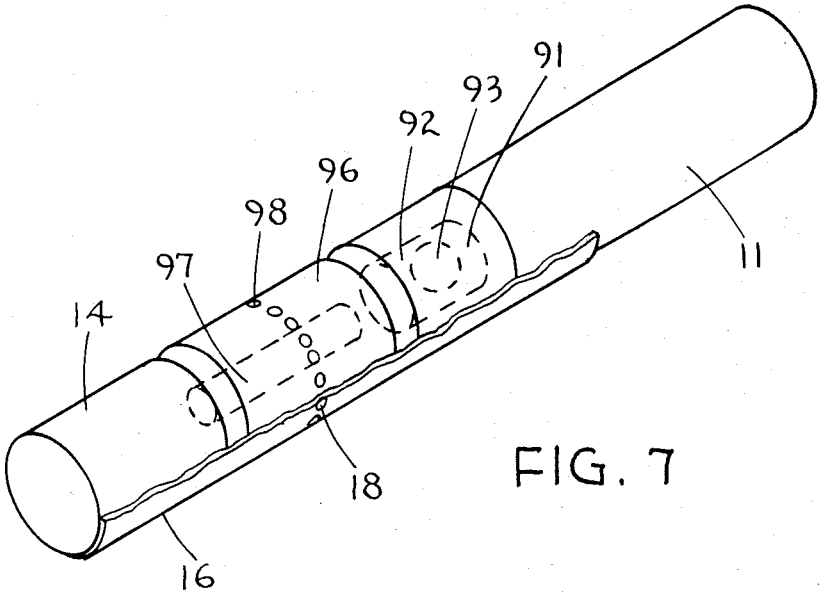
FIG. 7 is a three dimensional partially exploded view of a seventh embodiment of the present invention.

In FIG. 7, there is depicted an embodiment of the present invention which depends upon gravity for its operation rather than upon the resilience of a flexible member or a spring as is each of the preceding embodiments. In this embodiment, smoking material, such as tobacco, rod 11 is abutted by a chamber piece 91 having a cylindrical chamber 92 for containing a sphere or ball 93. The ball has a diameter of about 85% of the diameter of the chamber 92 so that the ball is free to move within the chamber. Shapes other than a sphere can also be used to perform the same function. Abutting the downstream face of chamber piece 91 is ventilation-valve piece 96. This piece 96 is provided with passageway 97 for carrying the puff flow stream from chamber piece 91 and ventilation air passageways 98 into optional cellulose acetate tow or other form of filter 14. These elements are all held together in cooperating relationship by tipping paper 16 which is provided with perforations 18 which are in registration with at least a portion of air passageways 98 in element 96. In order for this embodiment to function properly, it is important that the diameter of ball 93 be sufficiently less than the diameter of chamber 92 and sufficiently greater than the diameter of passageway 97 so that even in situations where the lighted end of the cigarette is somewhat higher than the filter end, the ball will merely lie in the lower corner of chamber 92 and not interfere with the flow of smoke from the smoking material until the puff flow velocity is sufficiently high to cause the ball to be picked up and held against the opening 97 in element 96, stopping the flow of smoke. When this occurs, the puff flow stream is converted from a mixture of predominately smoke and some ventilation air from openings 98 to predominately, if not all, air. It has been found that a chamber 92 diameter of 5.61 mm., a ball 93 diameter of 4.76 mm., and a passageway 97 diameter of 2.26 mm. results in reliable performance of this embodiment of the present invention.

Figure 8:
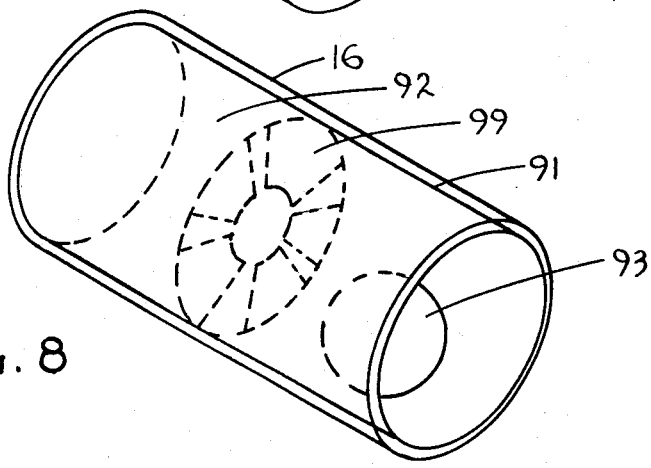
FIG. 8 is a three dimensional view of an embodiment of a valve means for use in the smoking article shown in FIG. 7.

In FIG. 8, there is shown a variation in chamber piece 91. In this embodiment, three or more flexible flaps 99 are secured to the inside wall of chamber 92. The length of these flaps is such that an imaginary circle just touching the tip of each of the flaps is only slightly smaller in diameter than the diameter of the ball 93. The purpose of these flaps 99 is to hold the ball away from the entrance to passageway 97 shown in FIG. 7 until a full-strength puff is taken which creates a sufficiently high puff flow rate to force the ball past the flexible flaps and against the opening of passageway 97. From this point on, the smoking of the cigarette proceeds normally for this embodiment as is described above. The embodiment shown in FIG. 8 permits a smoker, if desired, to take a puff at a below normal puff rate for a longer than normal time during a first puff after lighting a cigarette and thus increase the amount of full-strength smoke obtained.

Figure 9:
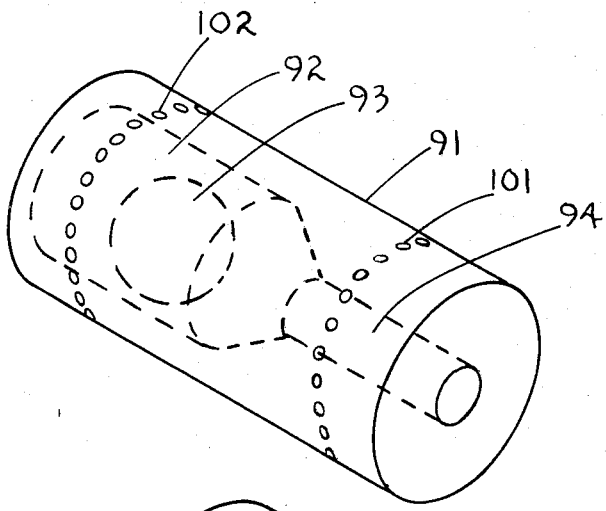
FIG. 9 is a three dimensional view of another embodiment of a valve means for use in the embodiment of the smoking article of the present invention shown in FIG. 7.

In FIG. 9, there is illustrated a valve piece 91 having ball chamber 92 for containing ball 93 and puff flow stream conduit 94. This piece may conveniently be made of plastic such as polyethylene or closed-cell foamed plastic such as polystyrene or molded filter tow. This piece shown in FIG. 9 is also provided with ventilation air conduits 101 for admitting atmospheric air into puff flow stream conduit 94 and optional ventilation air conduits 102 for admitting air into chamber 92 to provide additional air dilution of the smoke prior to the time during the puff when ball 93 closes the entrance to conduit 94. This embodiment operates in the same way as cooperating pieces 91 and 96 shown in FIG. 7.

Having thus described the invention, what is claimed is:

1. A smoking article comprising in combination a smoke producing material, air ventilation means for providing air to the smoking article and valve means operatively associated with said air ventilation means and adapted to move from a first position to a second position to substantially increase the concentration of air in the puff flow stream during the latter portion of each puff and then return to the first position.

2. A smoking article comprising in combination a smoke producing material, air ventilation means for providing air to the smoking article and valve means operatively associated with said air ventilation means and adapted to move from a first position to a second position during each puff to deliver to a smoker a stream containing a first concentration of smoke from the smoke producing material during the first portion of the puff and a second lower concentration of smoke and substantially increased concentration of air from the air ventilation means during the remainder of the puff and then return to the first position at the end of the puff.

3. The smoking article of claim 1 or 2 wherein said valve means comprises resilient membrane material adapted to cover and uncover smoke and air passageways repeatedly for each of successive puffs to regulate the concentrations of smoke and air delivered to a smoker in response to a puff drawn by the smoker.

4. The smoking device of claim 1 or 2 wherein said air ventilation means comprises a cylindrical duct, a tube positioned within said duct, the wall of which is provided with air ventilation conduits in communication with the atmosphere, a cylinder adapted to pass a limited flow of puff flow-stream therethrough slideably positioned within said tube, and resilient positioning means adapted to position said cylinder within said tube in blocking relationship with said conduits and permit axial movement of said cylinder is response to a smoker's puff reaching a predetermined flow rate to unblock said conduits and permit ingress of ventilation air.

5. The smoking article of claim 1 or 2 wherein said valve means includes a flexible cuplike member positioned within the mouthpiece end of the smoking article, the bottom portion thereof being provided with an opening for passage of the puff flow stream, the bottom of said cuplike member being adapted to move toward the mouth end of the smoking article in response to a puff by a smoker and uncover air ventilation openings to decrease the concentration of smoke in the puff flow stream and then return to the original position at the end of the puff.

6. A smoking article comprising in combination a smoke producing material, air ventilation means for providing air to the smoking article and valve means operatively associated with said air ventilation means adapted to substantially increase the concentration of air in the puff flow stream during the latter portion of each puff, wherein said valve means comprises a cylindrical portion positioned within the mouth end of the smoking article and provided with an axial passageway having a first diameter, a second cylindrical portion positioned upstream from said first cylindrical portion and provided with a central passageway having a second diameter greater than said first diameter, a sphere contained within said second cylindrical member, said sphere having a diameter intermediate said first diameter and said second diameter.

* * * * *